US008607526B2

(12) United States Patent
Walker

(10) Patent No.: US 8,607,526 B2
(45) Date of Patent: Dec. 17, 2013

(54) FOOT FREE CONCRETE FOUNDATION METHOD AND DEVICE

(71) Applicant: James Walker, Franconia, NH (US)

(72) Inventor: James Walker, Franconia, NH (US)

( * ) Notice: Subject to any disclaimer, the term of this patent is extended or adjusted under 35 U.S.C. 154(b) by 0 days.

(21) Appl. No.: 13/948,348

(22) Filed: Jul. 23, 2013

(65) Prior Publication Data

US 2013/0305654 A1 Nov. 21, 2013

Related U.S. Application Data

(62) Division of application No. 13/369,661, filed on Feb. 9, 2012, now Pat. No. 8,516,773.

(60) Provisional application No. 61/560,886, filed on Nov. 17, 2011.

(51) Int. Cl.
*E04B 1/00* (2006.01)

(52) U.S. Cl.
USPC ..... 52/742.14

(58) Field of Classification Search
USPC ..... 52/742.14, 220.2, 292, 293.1, 293.2, 52/293.3, 294, 295, 299
See application file for complete search history.

(56) References Cited

U.S. PATENT DOCUMENTS

| | | | |
|---|---|---|---|
| 921,626 | A | 5/1909 | Raster |
| 2,054,679 | A | 9/1936 | Nelson |
| 2,776,464 | A | 1/1957 | Stewart |
| 2,825,956 | A | 3/1958 | Shoemaker |
| 3,010,175 | A | 11/1961 | Shoemaker |
| 3,055,076 | A | 9/1962 | Van Heiden et al. |
| 3,071,837 | A | 1/1963 | Cerutti |
| 3,461,639 | A | 8/1969 | Merrill |
| 3,471,980 | A | 10/1969 | Archer et al. |
| 3,767,158 | A | 10/1973 | Mikus |
| 4,229,920 | A | 10/1980 | Lount |
| 4,783,935 | A | 11/1988 | Creager |
| 4,805,366 | A | 2/1989 | Long |
| 5,040,344 | A | 8/1991 | Durand |
| 5,323,578 | A | 6/1994 | Chagnon et al. |
| 5,651,635 | A | 7/1997 | Nagle |
| 5,735,090 | A | 4/1998 | Papke |
| 5,922,236 | A | 7/1999 | Zuhl |
| 6,443,418 | B1 | 9/2002 | Itamochi |
| 6,679,649 | B1 | 1/2004 | Capolupo |
| 6,698,710 | B1 | 3/2004 | VanderWerf |
| 6,739,102 | B2 | 5/2004 | Roy, Sr. |
| 6,931,806 | B2 | 8/2005 | Olsen |
| 7,404,272 | B2 | 7/2008 | Piche |
| 2010/0146877 | A1 | 6/2010 | Brandt et al. |

*Primary Examiner* — Mark Wendell
*Assistant Examiner* — Keith Minter
(74) *Attorney, Agent, or Firm* — Davis & Bujold, PLLC; Michael J. Bujold

(57) ABSTRACT

A foundation form comprising a first barrier, an opposed second barrier oriented at a non-right angle toward the first barrier, and a plurality of ties engaging with the first barrier and the second barrier at a plurality of axial lengths.

20 Claims, 14 Drawing Sheets

FOOT FREE CONCRETE FOUNDATION METHOD AND DEVICE

PRIORITY

This application claims priority to Provisional Patent Application No. 61/560,886, filed on Nov. 17, 2011.

FIELD OF THE INVENTION

The present invention relates to the field of forms for concrete foundations for buildings.

BACKGROUND OF THE INVENTION

Others have attempted to streamline the concrete foundation forming process for buildings in a variety of ways. U.S. Pat. No. 5,922,236 integrates footing by attaching specific footing forms to bottom of concrete forms and vertical walls. U.S. Pat. No. 4,783,935 has formed steel triangular footing and wall forms with vertical walls. U.S. Pat. No. 5,735,090 has modular concrete foundation walls cast integrally at a factory with a footing attached to regular vertical walls. The disclosures of these three patents are integrated into the present application as if fully restated herein. These patents teach supporting the foundation wall, but in a completely different method than the current invention.

SUMMARY OF THE INVENTION

Wherefore, it is an object of the present invention to overcome the above mentioned shortcomings and drawbacks associated with the prior art.

Another object of the present invention is to provide a foundation form that, when filled with concrete, will provide sufficient strength and foundation support for a building without the use of a separate footing.

A further object of the present invention is to provide a foundation form whereby the footing element and foundation wall element may be created in a single concrete pour.

The present invention also relates to a foundation forming device comprising a vertical barrier; an opposed inclined barrier; and a plurality of ties that engage with the barriers at different lengths.

The present invention also relates to a method of forming a building foundation comprising the steps of erecting a vertical barrier; erecting an opposed inclined barrier; securing the vertical barrier to the inclined barrier such that a void is created in between the vertical barrier and the inclined barrier; pouring a concrete mixture into the void.

The present invention also relates to a method of constructing a concrete foundation or a concrete foundation system without separate footings.

The present invention also relates to a method of constructing a concrete foundation or a concrete foundation system with integral footings.

The present invention also relates to a method of constructing a concrete foundation or a concrete foundation system that can be constructed in one pour which includes both the walls and footings.

The present invention also relates to a device used with a method of constructing a concrete foundation or a concrete foundation to tie forms together that can be adjusted in the field to accommodate various widths between forms.

The presently disclosed method and device relates to a method of using conventional concrete forms (including plywood, dimensional wood, OSB, metal, and Styrofoam) for residential and light commercial construction applications that substantially or completely eliminates the need for separate footings. The resulting method results in saving significant labor costs and approximately 2 or 3 days of construction time. The method is accomplished without the need for additional concrete such that the footing can be integral with the foundation wall and may be poured at the same time as the wall.

The method uses forms and formwork techniques whereby the interior wall form is formed and constructed vertically while the outside form slopes from a top horizontal dimension of approximately 6 inches to a bottom horizontal dimension typically of 16 inches (or wider depending on soil conditions). The cross section of the resulting concrete wall is a right trapezoidal shape with inherent increased strength where required—on the bottom—and a smaller thickness on the top where the thickness is neither required nor desired.

The presently disclosed method and device ideally includes a unique form of ties to releasably bind the forms together.

Additionally, the disclosed device includes a design for an adjustable tie suitable for use with horizontal elongate panels and vertical elongate panels, similar to Symons™ brand form panels and RAP-I-FORM® brand form panels, as well as plywood forms and metal forms.

This method of forming concrete walls involves forming concrete walls, preferably with normal and conventional vertical interior walls and a sloped or slanted exterior wall, such that the base of the wall is preferably 16 inches as is common with most foundations footing widths and the top of the wall is approximately 6 inches wide to enable to use a common 2×6 lumber sill plate.

The forms could accommodate a range of dimensions beyond the preferred layout with a wider bottom dimension for other soil conditions and the method provides for dimensions of 20 inch and 24 inch width bottom dimensions. The top can also vary depending on applications where more bearing width is needed or desirable.

The resulting formwork can provide normal vertical interior concrete walls for a basement or crawl space. The vertical walls could then be left unfinished or would allow for finishing the basement in a conventional manner for additional living space as is often done by many homeowners. The sloped exterior wall would not affect the spacing of the interior wall. The exterior would preferably slope outwards from the 6 inch width at the top to 16 inches at the bottom.

Interior and exterior corners can be easily constructed, according to the disclosed method, with the aid of plywood, OSB and standard dimensional lumber such as 2×4's. Ends may also be filled in using dimensional lumber and OSB or plywood. The dimensional lumber can be easily screwed to the forms and sheathing connected by screws or other fasteners.

The cross sectional area of the resulting footless foundation wall is approximately the same as the total cross sectional area of the same assembly constructed with an 8"×16" footing and an 8" thick 8 foot tall wall, or a 10"×24" footing with a 10 inch thick 8 foot tall wall, so minimal additional concrete is required. The method requires approximately the same total concrete yardage for a typical home.

As will be described in tables below, the angle of the exterior wall with the horizontal ground level generally ranges from 75 degrees to 86 degrees for six to ten foot walls, and from 65 to 75 degrees for shorter four foot frost walls or walls for crawl spaces.

The presently disclosed method and device can utilize both eight foot (96 inch) forms and ten foot (120 inch) panels, though the length of panels can also vary. The system is equally applicable for four foot forms for frost walls or crawl spaces.

The presently disclosed method utilizes ties which can be of varying length with one or more engagement points along the tie. The ties can alternatively be of a single length with multiple engagement points on the tie. The engagement points may be on a single pair of opposed surfaces on the tie, or on alternating opposed surfaces on the tie.

Latching and braces serve multiple functions with the presently disclosed method. First, the latches can lock the ties to prevent axial movement. Next the braces provide lateral support for the barriers against the weight of the non-set concrete pushing outward from the internal void.

The forms generally incorporate a 24 inch by 96 inch panels, between ⅜ inches thick 2.5 inches thick, but usually 1.125 inches thick, which may be oriented with the longer axis arranged vertically or horizontally. The edges of the panels may interconnect to one another at various spacing, typically 16 to 24 inches on center. These connections may also serve to connect steel ties to the forms from one wall to the forms used for the opposing wall. For the presently disclosed method and device, the ties may be graduated such that the interior clearances generally decrease as the height from the ground increases, as noted in the tables below.

Ties may also directly engage and clip to the form panels, thereby the ties defining the wall thickness and clipping adjacent form panels together. Horizontal spacing of the clips would be determined by the height and thickness of the wall, the temperature of the poured concrete, and the size and composition of the tie.

Styrofoam block forms and prefabricated metal forms, such as aluminum, could also be used according to the presently disclosed method with integrated ties. The ties being present, preferably, every 8 to 12 vertical inches at regular intervals for the Styrofoam block forms The corners and ends can be easily constructed with dimensional lumber and plywood or OSB. The end form is made by screwing dimensional lumber to the form and then attaching pieces of plywood or OSB as shown below. To form a closed end, the OSB is screwed directly into the ends of the forms and to attached dimensional lumber if necessary.

An outside corner may require dimensional lumber to be screwed to an extended exterior form. The OSB or plywood to close the form is then screwed to the dimensional lumber, for example, a 2×4. An inclined exterior form may be extended on one side to allow a connection of dimensional lumber to attach the closing piece of OSB or plywood. For example, a 2×4 may be used to attach a piece of OSB, which is screwed to the 2×4 and the inside of the adjacent form.

An inside corner may use conventional form accessories when the inside corner is vertical.

An advantage to the presently disclosed invention is that the wall and footing can be poured in one operation which may save significant labor time and cost. There would be some minimal additional labor to construct corners and ends as compared to conventional formwork, however, the net savings with the presently disclosed method and device could be significant. The formwork is simply placed directly on prepared compacted soil or undisturbed soil as would be done for the placement of footings.

This method can be used for both full height foundation walls and stem walls used for crawl spaces or frost walls.

In addition to cost savings, the presently disclosed method and device can also save time in the construction process, a valuable asset when dealing with the complicated scheduling of constructing a building.

Additionally, the end product is superior in that the walls are stronger where they need to be, which is on the bottom of the wall. A basement slab is also poured on the inside of the structure.

A traditional poured concrete foundation wall typically has an 8 inch by 16 inch footing under a 10 inch thick wall which is typically 8 feet high. The cross sectional area of the traditional configuration is 125 square inches for the footing plus 960 square inches for the wall for a total of 1,085 square inches or 7.53 square feet. The cross sectional area of the resulting wall of the presently disclose invention may be substantially similar to this amount, if not less than such amount.

Labor is required to form the footing, pour the footing, finish the footing, wait two days for the concrete to set, and then strip the footing. This labor would be substantially eliminated with the presently disclosed method and device.

Additionally, 8 inches of fill must be brought in and compacted in order to pour the slab. Again, this material and labor could be eliminated with the presently disclosed method and device, potentially resulting in significant savings in material, machinery, and labor.

BRIEF DESCRIPTION OF THE DRAWINGS

The invention will now be described, by way of example, with reference to the accompanying drawings in which.

DETAILED DESCRIPTION OF THE INVENTION

Figure 1:
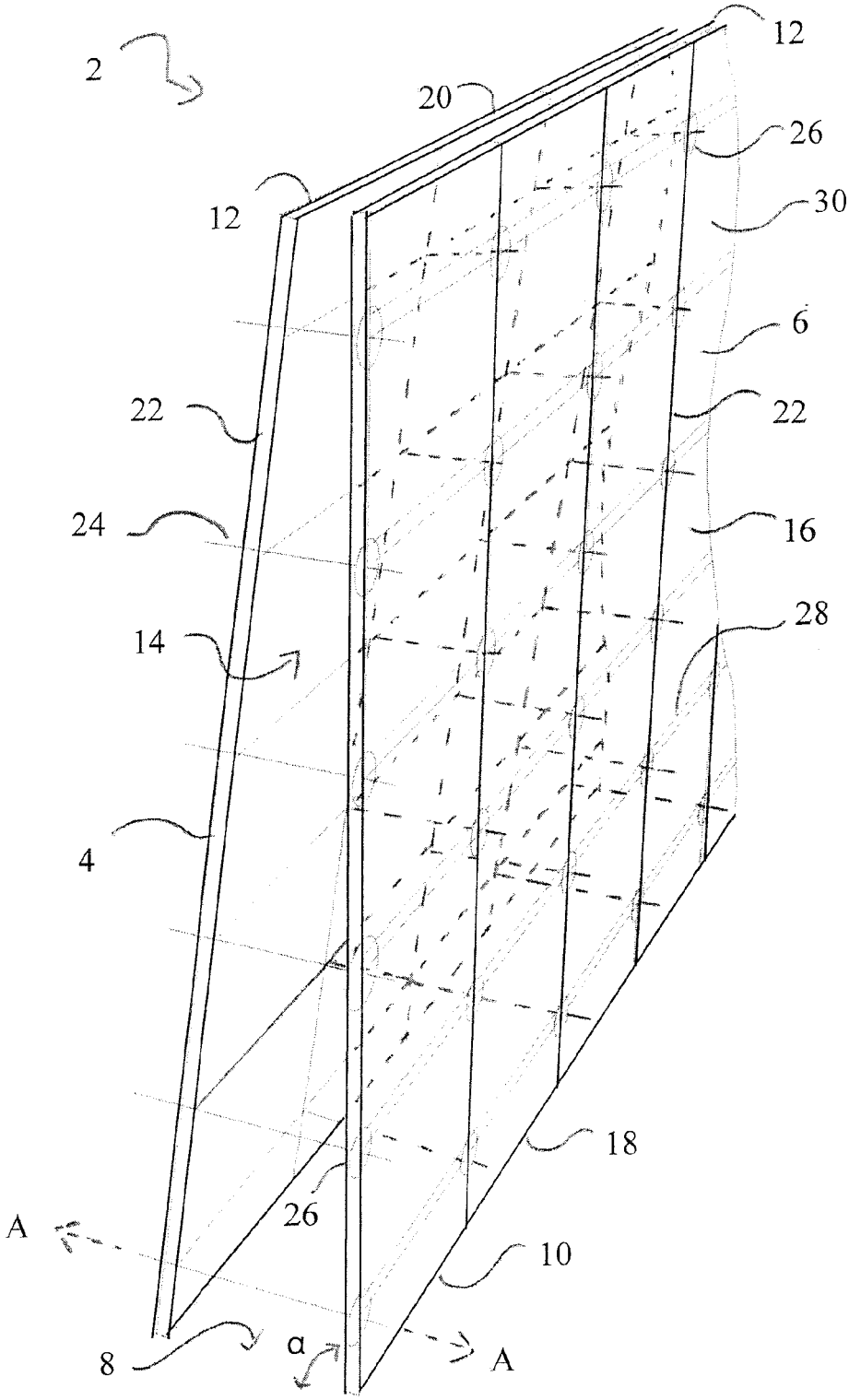
FIG. 1 is a diagram of a first embodiment of the footless form with vertical elongate panels.

Turning now to FIG. 1, a brief description concerning the various components of the present invention will now be briefly discussed. As can be seen in this embodiment, the footless form 2 includes an orthogonal barrier 4 and an inclined barrier 6. The orthogonal barrier 4 is arranged at substantially a right angle to the level compact ground 8, with a base edge 10 adjacent to the ground 8, and an upper edge 12 at a furthest distance from the ground 8. The inclined barrier 6 is arranged at a non-right angle to the ground 8, with a base edge 10 adjacent to the ground 8 and an upper edge 12 at a furthest distance from the ground 8. The inclined barrier 6 is inclined in the direction of the orthogonal barrier 4, with the distance separating the base edge 10 of the inclined barrier 6 from the base edge 10 of the orthogonal barrier 4 greater than distance separating the upper edge 12 of the inclined barrier 6 from the upper edge 12 of the orthogonal barrier 4. A primary angle of inclination $\alpha$ of the inclined barrier 6 to the ground 8 may have a constant slope up the height of the inclined barrier 6, and either or both the inclined barrier 6 and the orthogonal barrier 4 may partially or fully represent one or more flat planes. Together the orthogonal barrier 4, the ground 8, and the inclined barrier 6 define a right-trapezoid shaped interior void 14 which is shaped to accept poured concrete.

The orthogonal and the inclined barriers 4,6 are constructed from a plurality of vertical elongate panels 16, generally measuring 24 inches by 96 or 120 inches, with the long axis arranged vertically with respect to the compacted ground 8. In each of the orthogonal and the inclined barriers 4,6, the base edges 10 are formed by the plurality of bottom horizontal edges 18 of the vertical elongate panels 16 that comprise the respective barriers 4,6. The upper edges 12 in each of the orthogonal and the inclined barriers 4,6 are similarly formed by the plurality of upper horizontal edges 20 of the vertical elongate panels 16 that comprise the respective barriers 4,6. The vertical edges 22 of the adjacent vertical elongate panels 16 are arranged adjacent to one another, so as to form a substantially solid barrier for each of the orthogonal and the inclined barriers 4,6, but may overlap one another. The plurality of vertical elongate panels 16 are joined together with a combination of through-ties 24, latches 26, and horizontal bracing 28.

The horizontal bracing 28 preferably comprises of a plurality of horizontally elongate wood or metal units that are directly attached to the barriers 4,6 on the respective outer faces 30 opposite to the interior void 14, at regular intervals up the height of the barriers 4,6. The horizontal bracing 28 may measure the width of a single vertical elongate panel 16, the width of one and one half panels, or the width of multiple panels. Adjacent to the intersection of the horizontal bracing 28 and the adjacent vertical edges 22 of two adjacent vertical elongate panels 16, a plurality of through-ties 24 and associated latches 26 function to simultaneously releasably secure one vertical elongate panel 16 to an adjacent vertical elongate panel 16, and releasably secure the orthogonal barrier 4 to the inclined barrier 6.

Figure 3A:
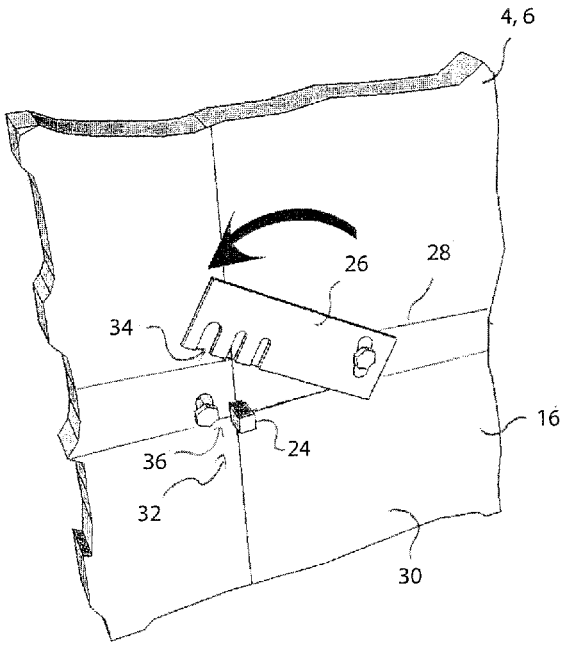
FIGS. 3A and 3B are close up view of the latch and through-tie coupling of FIG. 1, with the latch in the disengaged and engaged positions respectively.
Figure 3B:
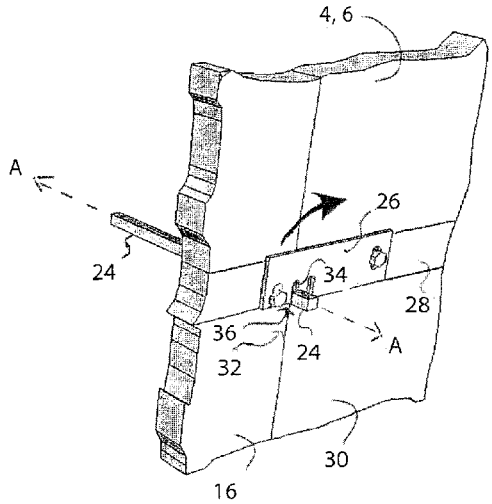
Figure 4:
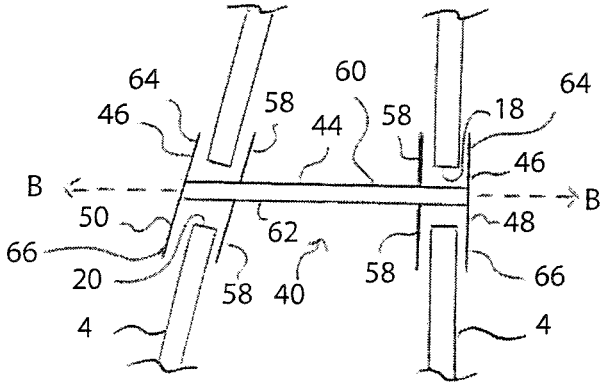
FIG. 4 is a partial exploded view of a clip-tie engaging adjacent panels of FIG. 2.
Figure 5A:
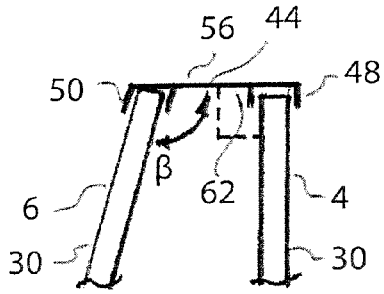
FIGS. 5A, 5B, and 5C are views of base edge clip-ties, intermediate clip-ties, and upper edge clip-ties of FIG. 2, respectively.
Figure 5B:
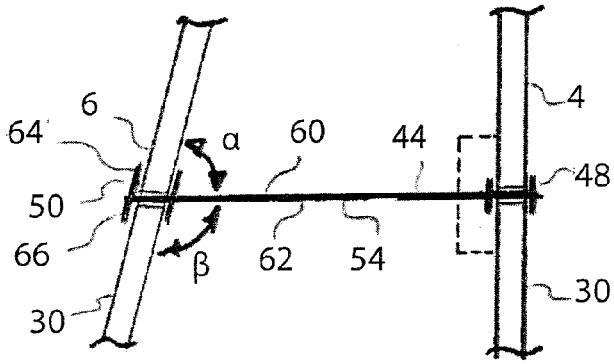
Figure 5C:
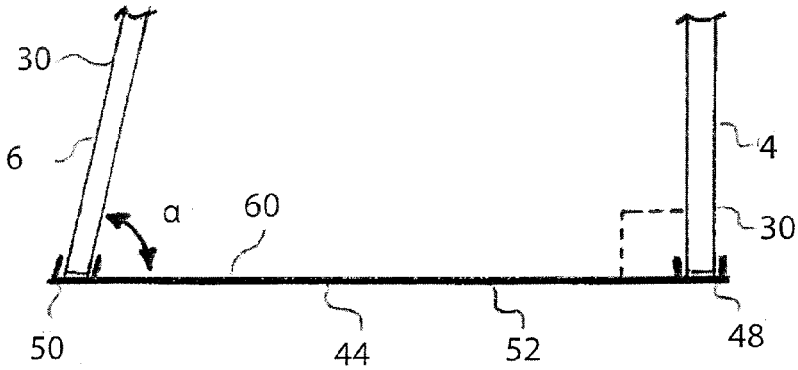
Figure 12:
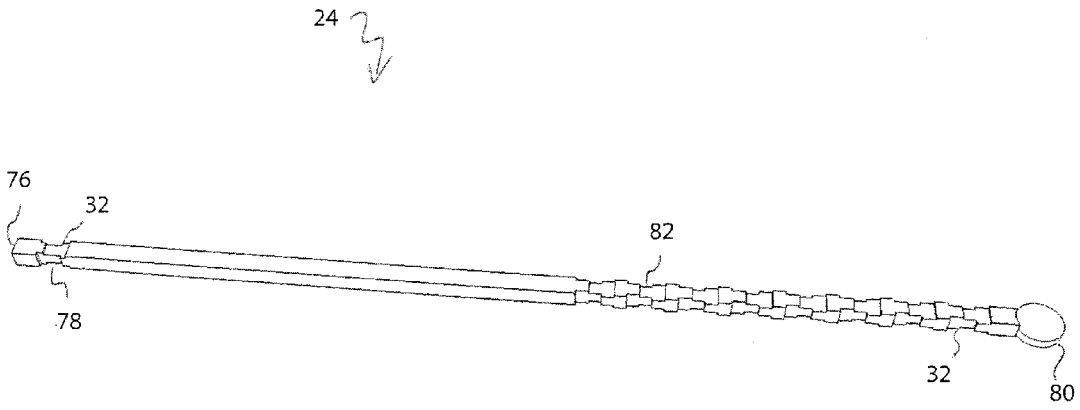
FIG. 12 is a view of a through-tie with notches on adjacent faces.

As seen in FIGS. 3A, 3B, and 12, the through-ties 24, which define an axial direction A, preferably have at least two notches 32 axially spaced from one another. The through-ties 24 are formed in varying axial lengths, or have a plurality of notches 32 at arranged at varying axial lengths along the through-ties 24, or both, such that an axial length between two notches 32 along a given through-tie 24 corresponds to the distance between two latches 26 on opposed barriers 4,6 at a given elevation above the level ground 8. Therefore, through-ties 24 to be used closer to the ground 8 will generally require a greater axial length, or a greater axial spacing between two notches 32, or both; whereas through-ties 24 to be used closer to the upper edge 12 can generally function with a shorter axial length, requiring a closer axial spacing between two notches 32, or both.

Each notch 32 is sized to receive the recess 34 of a respective latch 26, one on each of the orthogonal barrier 4 and the inclined barrier 6. The vertical elongate panels 16 and the horizontal bracing 28 each have through-holes 36 to allow for the through-ties 24 to pass there through. The latches 26 are pivotally arranged on the horizontal bracing 28 to be rotated in a first direction to engage and realisably axially secure the through-ties 24, and rotated in a second opposite direction to disengage the through-ties 24, and allow the barriers 4,6 and the through-ties 24 to be moved with respect to one another in the axial direction of the through-ties 24. The latches 26 are also preferably attached to the vertical elongate panel 16, and when rotated in the first direction also will preferably engage an adjacent vertical elongate panel 16.

To assemble the footless form 2, first the horizontal bracing 28 is attached to the vertical elongate panels 16 at the appropriate positions along the height of the panels. The spacing of the horizontal bracing 28 is preferably slightly father apart on vertical elongate panels 16 that will form the inclined barrier 6 than the spacing on the vertical elongate panels 16 that form the orthogonal barrier 4, so that the horizontal bracing 28 on the same level of each of the orthogonal and the inclined barriers 4,6, once erected, are approximately parallel with one another and equidistance from the ground 8 along their axial length. The latches 26 may be previously attached to the horizontal bracing 28, or may be attached after the horizontal bracing 28 is attached to the vertical elongate panels 16.

Then, two vertical elongate panels 16 are erected at substantially a right angle to the ground 8, the two panels arranged adjacent to and co-planar with one another, to form the first part of the orthogonal barrier 4. Two vertical elongate panels 16 are next erected at the primary angle of inclination $\alpha$ to the ground 8, these two panels also arranged adjacent to and co-planar with one another, to form the first part of the inclined barrier 6. With the latches 26 rotated in an disengaged position, a plurality of through-ties 24 are then threaded in an axial direction through the through-holes 36 in each of the vertical elongate panels 16 and horizontal bracing 28 of each of the orthogonal and the inclined barriers 4,6, until the first and second notches 32 on each through-tie 24 are positioned to received the respective latches 26 on the orthogonal and the inclined barriers 4,6, and the through-ties 24 are substantially parallel to one another and the level ground 8. The latches 26 on the orthogonal and the inclined barriers 4,6 are then rotated in the first position to engage adjacent vertical elongate panels 16, and engage and realisably axially secure the through-ties 24. The latch 26/through-tie 24 engagement aids in transforming the separate composite parts of the footless form 2 into a unitary structure. Once all the through-ties 24 are inserted through the through-holes 36 and secured with the latches 26, another vertical elongate panel 16 for each the orthogonal barrier 4 and the inclined barrier 6 are erected adjacent to uncoupled vertical edges 22 of the previously erected vertical elongate panels 16, and the process is repeated until the form for the building foundation is completed. Corners and ends may be constructed with OSB or plywood sheets and dimensional lumber such as 2×4's.

After the all the forms 2 are erected, with the interior void 14 defining the future foundation for the building, concrete is poured into the interior void 14, preferably in a single pour in a single day. After the concrete has set and cured, the latches 26 are rotated into the disengaged position, and the plurality of vertical elongate panels 16 are pulled axially away from the through-ties 24, which at this point are embedded in the set concrete. Any surplus length of the through-ties 24 that extend from the set concrete may be cut or hammered off, as desired.

Figure 2:
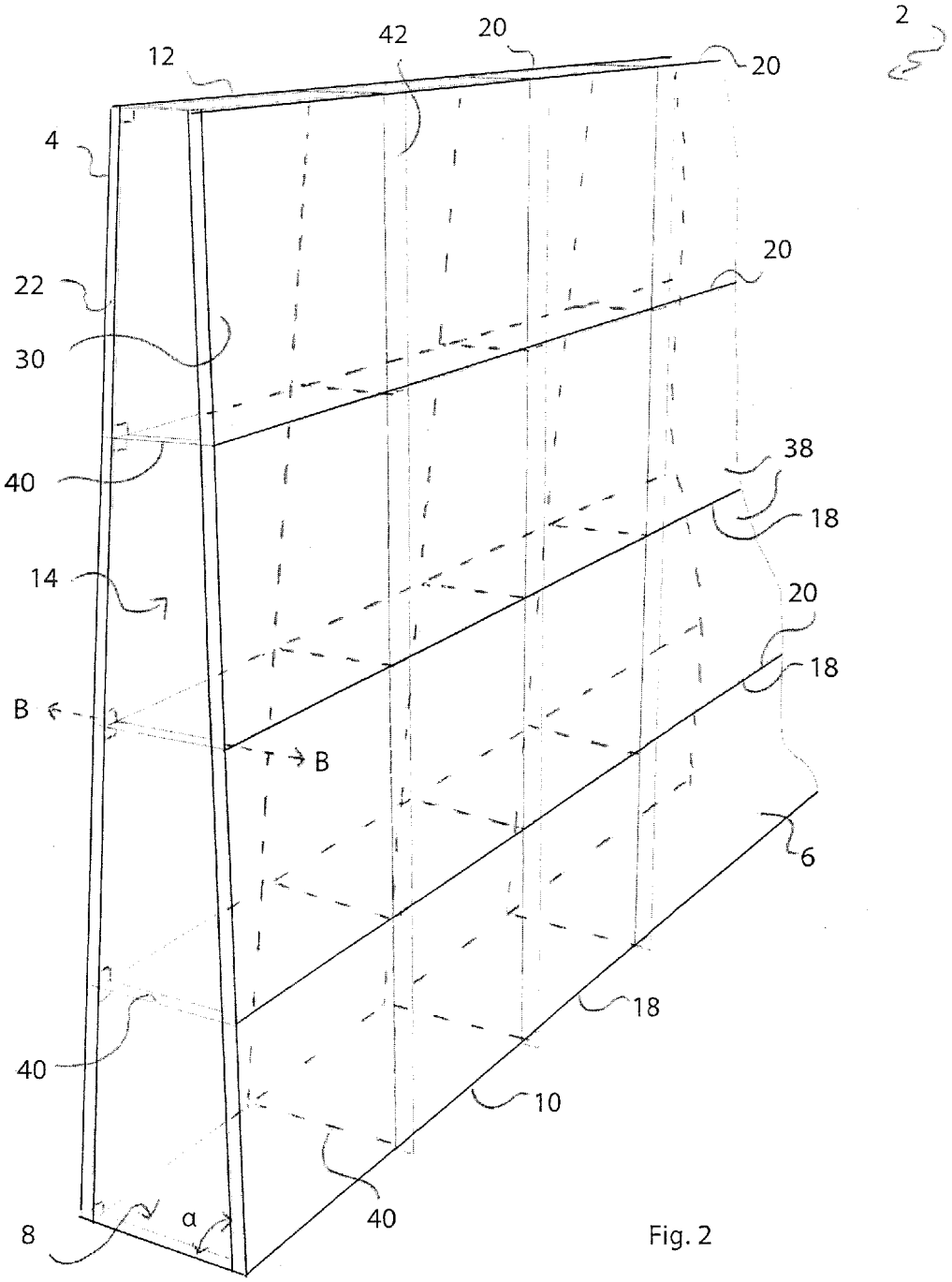
FIG. 2 is a diagram of a second embodiment of the footless form with horizontal elongate panels.

Turning to FIG. 2, a second embodiment of the present invention is shown. In this embodiment, horizontal elongate panels 38 are used in the place of vertical elongate panels 16 for both the orthogonal and the inclined barriers 4,6. Similar to vertical elongate panels 16, the horizontal elongate panels 38 generally measure 24 inches by 96 of 120 inches, except in this embodiment the long axis is arranged horizontally with respect to the level ground 8. In each of the orthogonal and the inclined barriers 4,6, the base edges 10 are formed by the plurality of bottom horizontal edges 18 of the bottom most horizontal elongate panels 38 that comprise the respective barriers 4,6. The upper edges 12 in each of the orthogonal and the inclined barriers 4,6 are similarly formed by the plurality of upper horizontal edges 20 of the upper most vertical elongate panels 16 that comprise the respective barriers. The remaining bottom horizontal edges 18 and upper horizontal edges 20, along with the vertical edges 22 of adjacent horizontal elongate panels 38 are arranged adjacent to one another, so as to form a substantially solid barrier for each of the orthogonal and the inclined barriers 4,6. The plurality of horizontal elongate panels 38 are joined together with a combination of clip-ties 40 and vertical and/or horizontal bracing 42, 28.

The vertical bracing 42 preferably comprises of a plurality of horizontally elongate wood or metal units that are directly attached to the barriers 4,6 on the respective outer faces 30 opposite to the interior void 14, at regular intervals along the length of the barriers 4,6. The vertical bracing 42 will preferably be horizontally spaced between 16" and 96" apart, more preferably spaced between 24" and 60" apart, and most preferably spaced between 36" and 48" apart, and may vary depending on the height of the completed wall. The vertical bracing 42 may measure the height of a single horizontal elongate panels 38, the height of one and one half horizontal elongate panels 38, the height of multiple horizontal elongate panels 38, or preferably, substantially the distance from the base edge 10 of a barrier 4,6 to the upper edge 12 of a barrier 4,6. Vertical bracing 42 will preferably be arranged to overlap adjacent horizontal edges 18, 20 of adjacent horizontal elongate panels 38.

Preferably, adjacent to the intersection of the vertical bracing 42 and the adjacent horizontal edges 18, 20 of two adjacent horizontal elongate panels 38, a plurality of clip-ties 40 function to simultaneously releasable secure one horizontal elongate panel 38 to an adjacent horizontal elongate panel 38, and releasably secure the orthogonal barrier 4 to the inclined barrier 6. The clip-ties 40 may be used with or without the vertical bracing 42, and arranged flush with the vertical bracing 42 or spaced from the vertical bracing 42. The clip-ties 40 are generally spaced such that adjacent clip-ties 40 on the same horizontal level are between 8" and 60" apart, preferably between 12" and 48" apart, more preferably between 16" and 36" apart, and most preferably between 24" and 32" apart.

As shown in FIGS. 4, 5A, 5B, and 5C, the clip-ties 40, which define an axial direction B, are comprised of a shank 44 and two opposed clip heads 46—each clip-tie 40 preferably comprising an orthogonal clip head 48 and an inclined clip head 50. The length of the shank 44 and the shape of the clip heads 46 will vary based on the designated position in the footless forms 2 the respective clip-tie 40 is to be placed, but are preferably elongate, with the clip heads 46 adjacent each end of the shank 44. The various clip-ties 40 include base edge clip-ties 52, intermediate clip-ties 54, and upper edge clip-ties 56, each having different axial length and different shaped clip heads 46. The axial length will correspond to the distance between the outer faces 30 of the two barriers 4,6 where the clip-ties 40 are placed, with clip-ties 40 designed to be attached vertically closer to the ground 8 having generally longer axial length, and clip-ties 40 designed to be attached vertically farther from the ground 8 having generally shorter axial length.

The clip heads 46 are provided with one or more coupling elements 58 designed to receive an upper horizontal edge 20 or a bottom horizontal edge 18, or both. The base edge clip-ties 52 have clip heads 46 that are designed to receive the bottom horizontal edge 18 of the bottom most horizontal elongate panels 38 of both the orthogonal barrier 4 and the inclined barrier 6, with a coupling element 58 on the inclined clip head 50 being inclined at an angle to the shank 44 equal to the primary angle of inclination $\alpha$, and the coupling element 58 of the orthogonal clip head 48 being at a right angle to the shank 44. The upper edge clip-ties 56 are designed to receive the upper horizontal edge 20 of the upper most horizontal elongate panels 38 of both the orthogonal barrier 4 and the inclined barrier 6, with the coupling element 58 on the inclined clip head 50 being inclined at an angle to the shank 44 equal to a supplementary angle $\beta$ of the primary angle of inclination $\alpha$, and the coupling element 58 of the orthogonal clip head 48 being at a right angle to the shank 44. The clip heads 46 on the base edge clip-ties 52 and the upper edge clip-ties 56 are preferably arranged on either a single upper side 60 or a single lower side 62 of the shank 44 respectively, with the clip heads 46 receiving panels from only one of a generally upper or lower direction.

The intermediate clip-ties 54, on the other hand, are designed to receive both an upper horizontal edge 20 and a bottom horizontal edge 18 of two adjacent horizontal elongate panels 38, from each of the orthogonal barrier 4 and the inclined barrier 6, into each of the orthogonal clip head 48 and the inclined clip head 50 respectively. On the inclined clip head 50 of the intermediate clip-ties 54, an upper coupling element 64 on an upper side 60 of the shank 44 is inclined at an angle to the shank 44 equal to the primary angle of inclination $\alpha$, and a lower coupling element 66 on a lower side 62 of the shank 44 is inclined at an angle to the shank 44 equal to a supplementary angle $\beta$ of the primary angle of inclination $\alpha$, and therefore is also supplementary with the angle formed by the upper coupling element 64. On the orthogonal clip head 48 of the intermediate clip-ties 54, both an upper and a lower coupling element 64, 66 on a respective upper side 60 and lower side 62 of the shank 44 are inclined at a right-angle to the shank 44.

To assemble the footless form 2 of the second embodiment, first, a plurality of base edge clip-ties 52 are coupled to the bottom horizontal edge 18 of a horizontal elongate panel 38, on one of the orthogonal clip head 48 or the inclined clip head 50. Next, the base edge 10 of a second horizontal elongate panel 38 is coupled to the other of the orthogonal clip head 48 or the inclined clip head 50 of the base edge clip-ties 52. Then, the lower coupling elements 66 of a plurality of intermediate clip-ties 54 are coupled with the upper horizontal edges 20 of the horizontal elongate panels 38 on the orthogonal and the inclined barriers 4,6. This step is repeated, adding additional horizontal elongate panels 38 until the desired height of the respective barriers 4,6 is reached, and then the coupling elements 58 on the upper edge clip-ties 56 are coupled with the upper horizontal edge 20 of the upper most horizontal elongate panels 38 on both the orthogonal and the inclined barriers 4,6. Next, vertical and or horizontal bracing 42, 28 may be attached to the outer faces 30 of the orthogonal and the inclined barriers 4,6. These steps are repeated to extend the footless form 2 in a horizontal direction, until the footless form 2 for the building foundation is completed, with each of the clip-ties 40 being arranged substantially parallel to each other and the level ground 8.

In erecting the footless form 2 of the second embodiment, different vertical levels of horizontal elongate panels 38 may be horizontally staggered, such that the vertical edges 22 of one level do not align with the vertical edges 22 of an upper or lower adjacent level. Also, vertical edge clips or other fastening elements may be used to realisably attach one horizontal elongate panel 38 to a horizontally adjacent horizontal elongate panel 38. The corners and ends may be closed with plywood or OSB panels and dimensional lumber such as 2×4's.

After the all the forms are erected, with the interior void 14 defining the future foundation for the building, concrete is poured into the interior void 14, preferably in a single pour in a single day. After the concrete has set and cured, the vertical bracing 42 is removed and the coupling elements 58 are pried open, releasing the horizontal elongate panels 38. Any surplus length of the clip-ties 40 that extend from now set concrete may be cut or hammered off or hammered flat, as desired.

Figure 6:
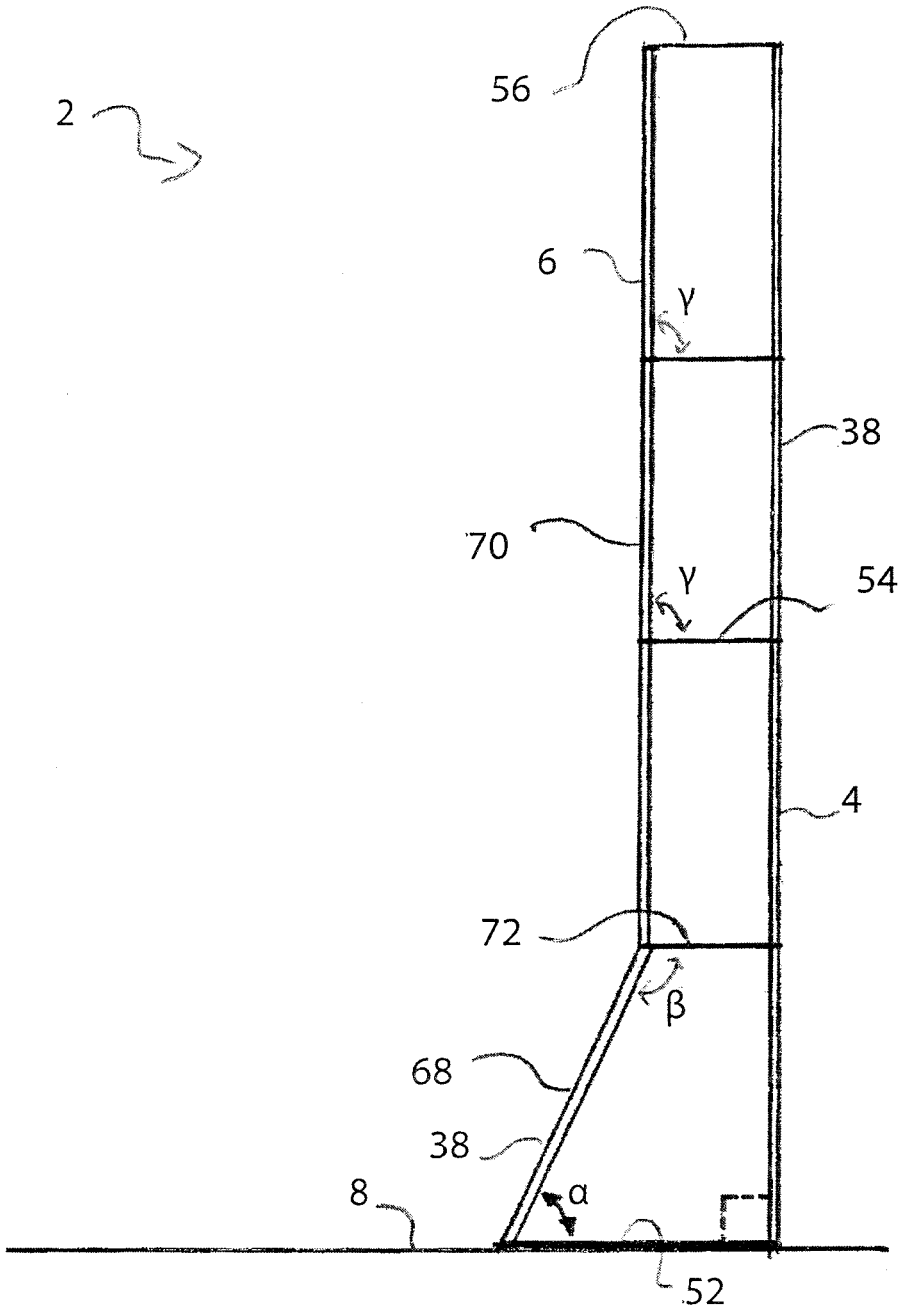
FIG. 6 is a view of a third embodiment of the footless form with a non-planar inclined barrier.
Figure 7:
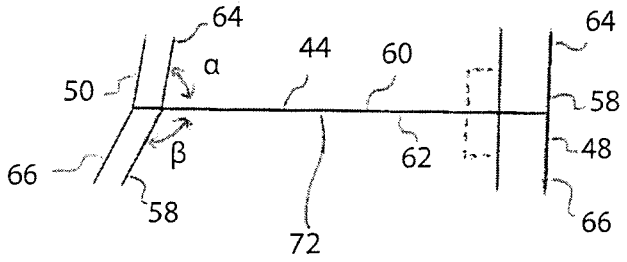
FIG. 7 is a view of a non-supplementary intermediate clip of FIG. 6.

Turning to FIGS. 6 and 7, a third embodiment of the present invention is shown. In this embodiment the inclined barrier 6 is not uniformly planar, with two distinct slopes on at least two sections of the inclined barrier 6, a more shallow sloped lower section 68, and a more steeply sloped upper section 70. The upper section 70 may even be oriented at a right angle to the ground 8. This embodiment will preferably utilize horizontal elongate panels 38 and clip-ties 40 as in the second embodiment. At least one distinction with this third embodiment is that at least one intermediate clip-tie 54 will be a non-supplementary intermediate clip-tie 72, where the upper coupling element 64 on the upper side 60 of the shank 44 of the inclined clip head 50 is inclined at a secondary angle of inclination $\gamma$ to the shank 44, which is greater than the primary angle of inclination $\alpha$, while the lower coupling element 66 on a lower side 62 of the shank 44 is inclined at an angle to the shank 44 equal to a supplementary angle $\beta$ of the primary angle of inclination $\alpha$ thereby causing the upper coupling element 64 to be non-supplementary with the lower coupling element 66 on the inclined clip head 50. The secondary angle of inclination $\gamma$ may measure up to and including a right angle to the shank 44. The coupling elements 58 of the orthogonal clip head 48 of the non-supplementary intermediate clip-ties 72 are similar to the previously described intermediate clip-ties 54 in that both an upper and a lower coupling element 64, 66 on a respective upper side 60 and lower side 62 of the shank 44 are inclined at a right-angle to the shank 44.

All the intermediate clip-ties 54 and all the upper edge clip-ties 56 vertically above the non-supplementary intermediate clip-tie 72 will be as described in the second embodiment, except that the coupling elements 58 on the inclined clip heads 50 of these vertically elevated clip-ties 40 will be oriented as if the primary angle of inclination $\alpha$ to the level ground 8 equaled the secondary angle of inclination $\gamma$. In this embodiment, when the secondary angle of inclination $\gamma$ is a right angle, the two barriers 4,6 will both extend upward parallel to one another and orthogonal to the level ground 8 vertically above the non-supplementary intermediate clip-tie 72. Assemblage of this embodiment of the footless form 2 is similar to the steps described in the second embodiment.

It is to be noted that different non-supplementary intermediate clip-ties 72 may be used on successive vertically higher levels of horizontal elongate panels 38. Each successive level of non-supplementary intermediate clip-ties 72 would have upper coupling elements 64 on the upper side 60 of the respective shanks 44 inclined at an new angle of inclination $\gamma_{x+1}$ to the shank 44 that is less than or greater than the previous angle of inclination $\gamma_x$.

Figure 8:
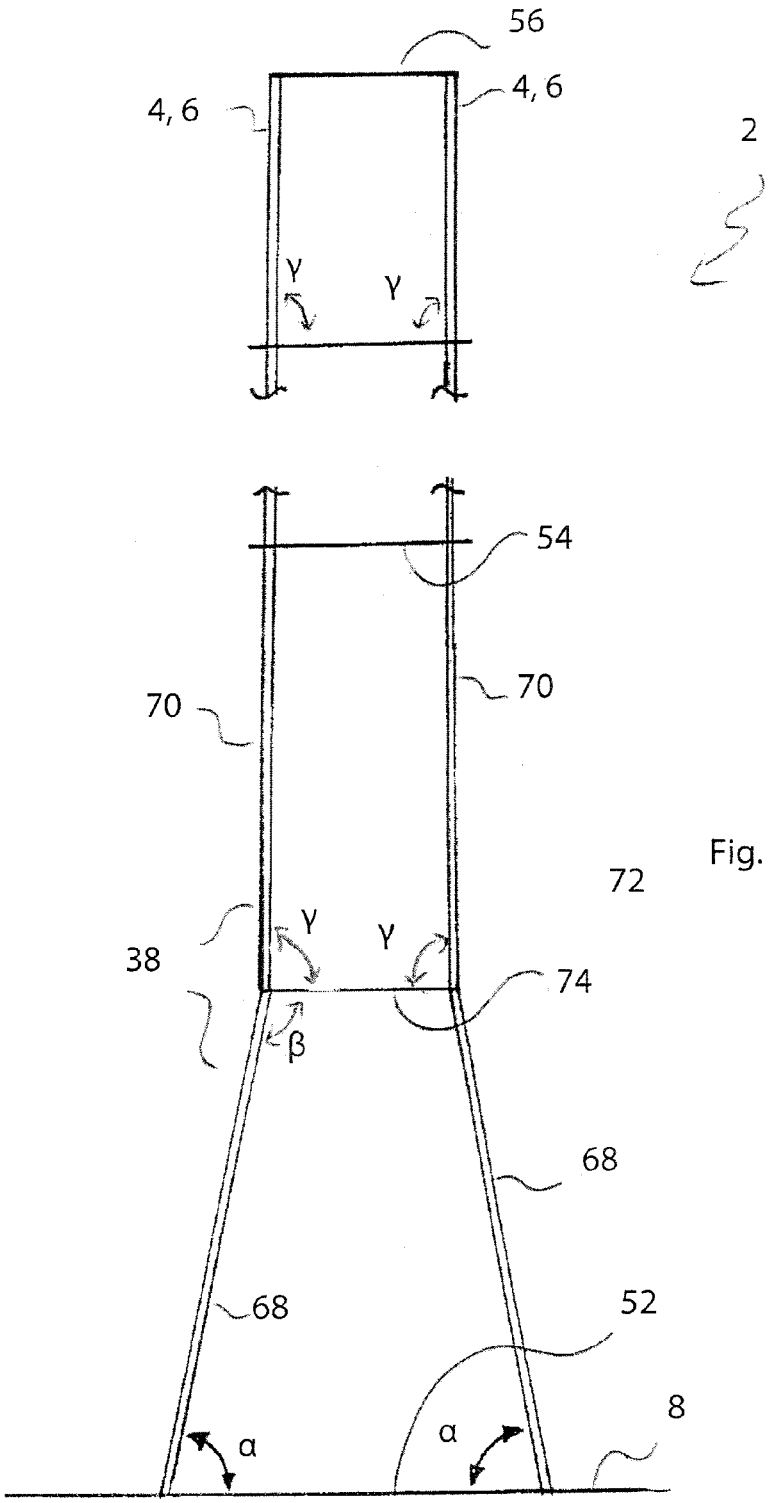
FIG. 8 is a view of a fourth embodiment of the footless form with two non-planar barriers.
Figure 9:
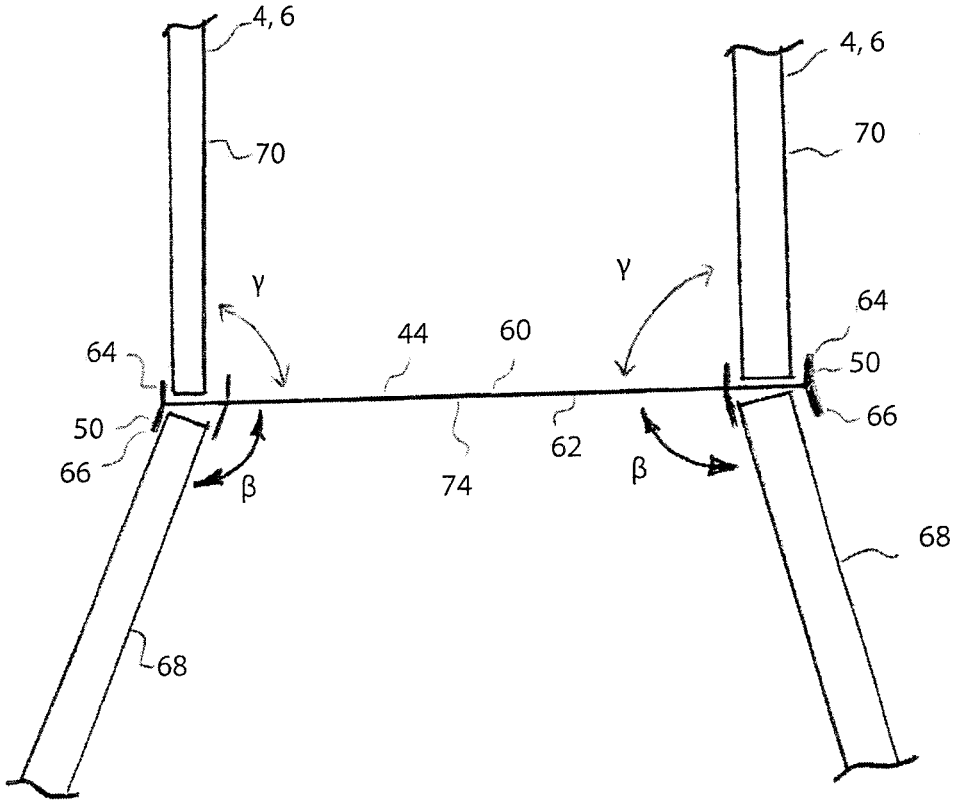
FIG. 9 is a view of a hyper non-supplementary intermediate clip of FIG. 8.
Figure 10:
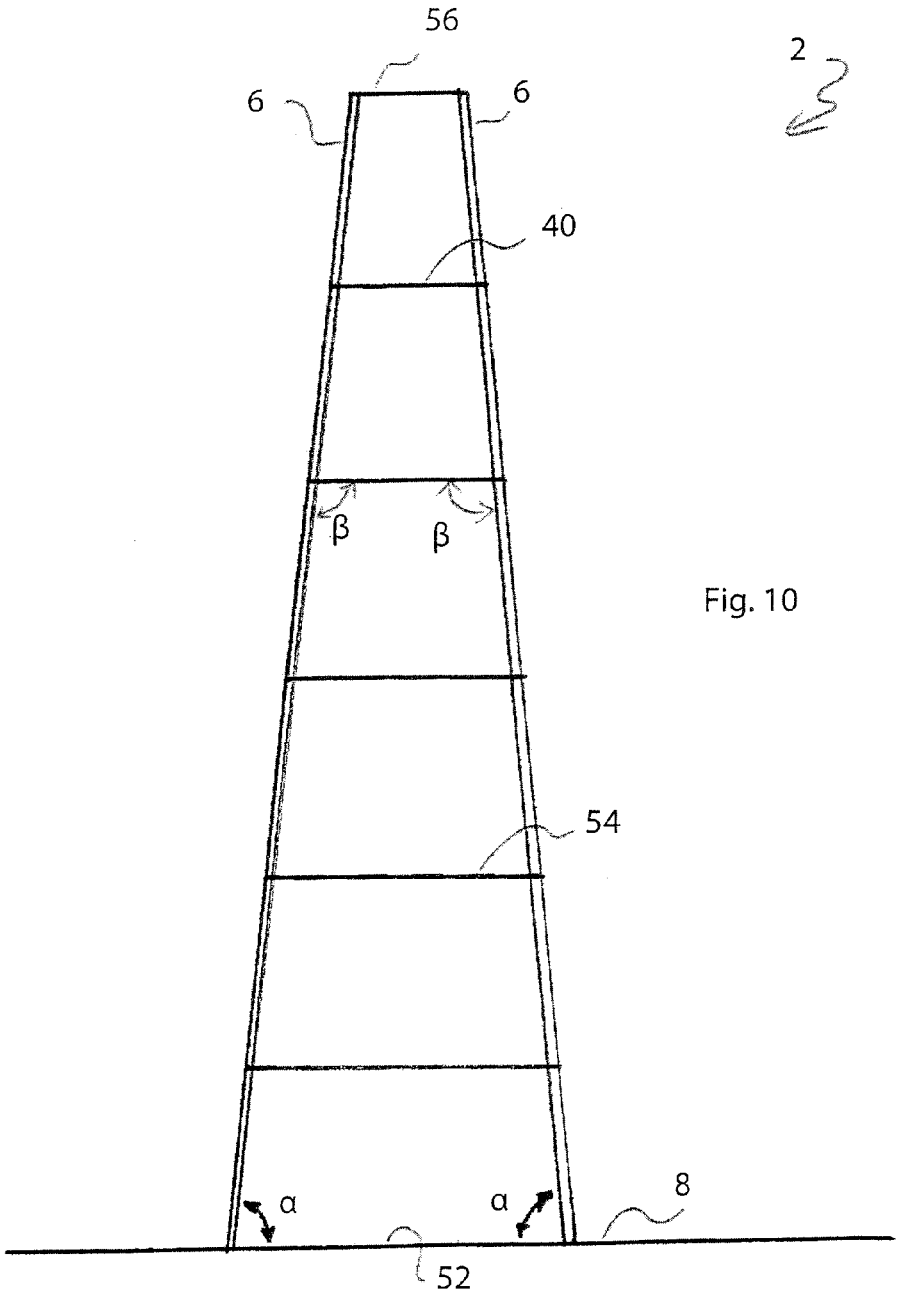
FIG. 10 is a view of fifth embodiment of the footless form with a double sloped wall.
Figure 11A:
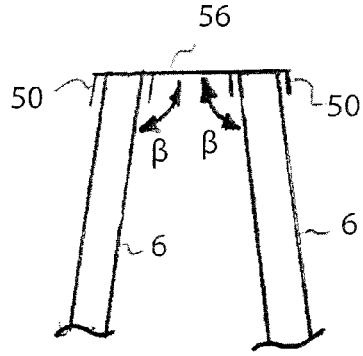
FIGS. 11A, 11B, and 11C are views of congruent base edge clip-ties, congruent intermediate clip-ties, and congruent upper edge clip-ties of FIG. 10 respectively.
Figure 11B:
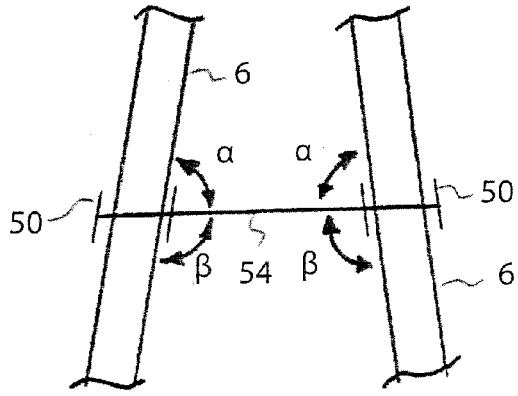
Figure 11C:
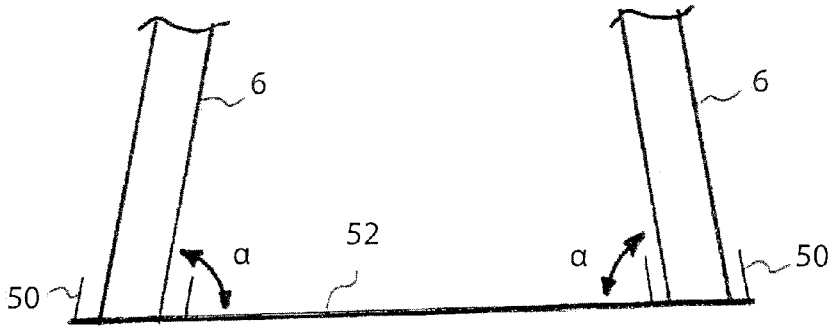

Turning to FIGS. 8 and 9, a fourth embodiment of the present invention is shown. In this embodiment both barriers 4,6 are not uniformly planar, each having two distinct slopes on at least two sections—a more shallow sloped lower section 68, and a more steeply sloped upper section 70. The two sections 68,70 of each barrier 4,6 can be congruent to one another in slopes and height, as depicted in FIG. 8, or they be incongruent in slopes or height, or both. Footless forms 2 of the fourth embodiment, as shown in the figure, will preferably utilize horizontal elongate panels 38 and clip-ties 40 as in the second and third embodiment. A first distinction with these embodiments is that all the clip-ties 40 will have congruent inclined clip heads 50 on both axial ends of the shank 44. This will cause both barriers 4,6 to be inclined with respect to the ground 8 where they are adjacent to the ground 8, each being inclined with respect to the shank 44 equal to the primary angle of inclination $\alpha$. A second distinction is that, at least one intermediate clip-tie 54 will be a hyper non-supplementary intermediate clip-tie 74, where the upper coupling element 64 on the upper side 60 of the shank 44 of both inclined clip heads 50 are inclined at a secondary angle of inclination $\gamma$ to the shank 44, which is greater than the primary angle of inclination $\alpha$. The secondary angle of inclination $\gamma$ may measure up to and including a right angle with the shank 44. All the intermediate clip-ties 54 and all the upper edge clip-ties 56 vertically above the hyper non-supplementary intermediate clip-tie 74 will be similar to the non-supplementary intermediate clip-tie 72 of the third embodiment (i.e., the coupling elements 58 on the inclined clip heads 50 of these vertically elevated clip-ties 40 will be oriented as if the primary angle of inclination $\alpha$ to the level ground 8 equaled the secondary angle of inclination $\gamma$), except there will be inclined clip heads 50 on both axial ends of the clip-ties 40. Similar to the third embodiment, when the secondary angle of inclination $\gamma$ for the two congruent inclined clip heads 50 is a right angle, above the hyper non-supplementary intermediate clip-tie 74 the two barriers 4,6 will both extend upward parallel to one another and orthogonal to the level ground 8. Assemblage of this embodiment of the footless form 2 is similar to the steps described in the second embodiment.

It is to be noted that different hyper non-supplementary intermediate clip-ties 74 may be used on successive vertically higher levels of horizontal elongate panels 38. Each successive level of hyper non-supplementary intermediate clip-ties 74 would have upper coupling elements 64 on the upper side 60 of the respective shanks 44 inclined at an new angle of inclination $\gamma_{x+1}$ to the shank 44 that is less than or greater than the previous angle of inclination $\gamma_x$.

In a variation of the fourth embodiment, the first and the second inclined barriers 6 may be non congruent with one another. Either inclined barrier 6 may begin at a right angle adjacent to the ground 8, decrease its slope at a higher elevation above the ground 8, and potentially increase or decrease its slope one or more times as it increases in elevation above the ground 8, including increasing to right angles with the ground 8. Similarly, either inclined barrier 6 may begin at an inclined non-right angle adjacent to the ground 8, and potentially increase or decrease its slope one or more times as it increases in elevation above the ground 8, including increasing to right angles with the ground 8. As these slopes change at a given height on a first inclined barrier 6, the slope of the second inclined barrier 6 may stay the same, may change in the same direction (i.e., increase or decrease) to the same magnitude, or may change in a different direction or to a different magnitude, or both. In this variation of the fourth embodiment, at a given height when a first inclined barrier 6 changes to a different slope than the second inclined barrier 6, a variation of the hyper non-supplementary intermediate clip-tie 74 is used, but the coupling elements 58 on the inclined clip heads 50 will not be congruent with one another.

Turning to FIGS. 10, 11A, 11B, and 11C, a fifth embodiment of the present invention is shown. In this embodiment both barriers 4,6 are uniformly planar and each has a single slope. In the version of the embodiment shown in FIG. 10, both barriers are inclined barriers 6, inclined toward one another at congruent angles, with each having an identical primary angle of inclination α of the inclined barrier 6 to the level ground 8. This embodiment may be constructed of through-ties 24 and latches 26 as in the first embodiment, or with clip-ties 40 as in the second embodiment, and with either horizontal or vertical elongate panels 38, 16. If clip-ties 40 are used, similar to the fourth embodiment, all the clip-ties 40 will have congruent inclined clip heads 50 on both axial ends of the shank 44.

In a variation of the fifth embodiment, the two inclined barriers 6 may have different slopes and have distinct primary angles of inclination α. This variation may also be constructed of through-ties 24 and latches 26 as in the first embodiment, or with clip-ties 40 as in the second embodiment, and with either horizontal or vertical elongate panels 38, 16. If clip-ties 40 are used, similar to the fourth embodiment, all the clip-ties 40 will have inclined clip heads 50 on both axial ends of the shank 44, except that the inclined clip heads 50 on a first axial end of the shanks 44 will be incongruent with the inclined clip heads 50 on the second axial end of the shanks 44.

It is to be appreciated that clip-ties 40 may be used with vertical elongate panels 16, and through-ties 24 and latches 26 may be used with horizontal elongate panels 38 in any of the disclosed embodiments. Further vertical bracing 42 may be used with vertical elongate panels 16, and horizontal bracing 28 may be used with horizontal elongate panels 38 in any of the disclosed embodiments. Additionally, clip-ties 40 and through-ties 24 and latches 26 may be used in combination with either horizontal elongate panels 38 or vertical elongate panels 16 in any of the disclosed embodiments, as may vertical and horizontal bracing 42, 28 be using in combination with either panel type 16, 38 in any of the disclosed embodiments.

Figure 13:
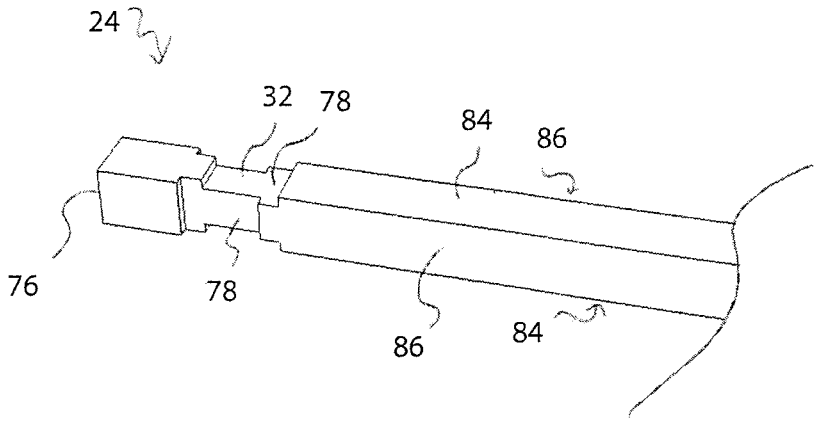
FIG. 13 is a close up view of a first end of the through-tie of FIG. 12.
Figure 14:
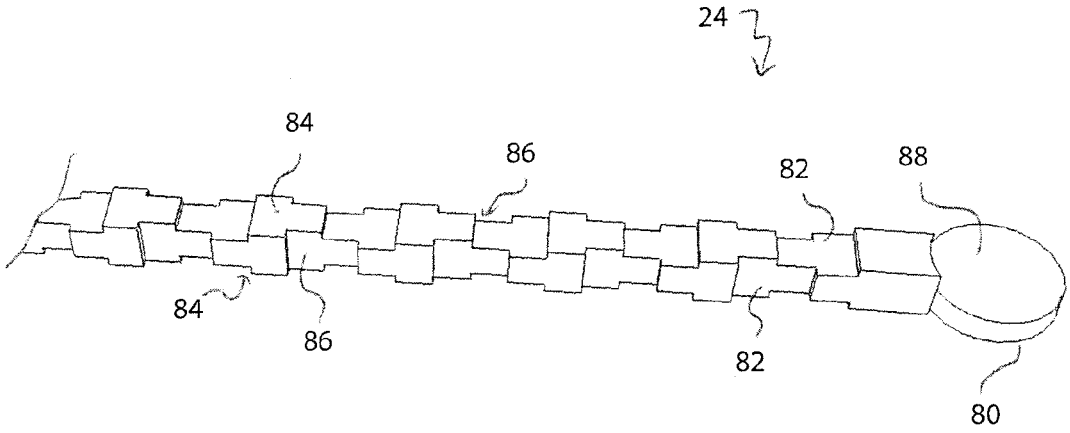
FIG. 14 is a close up view of a second end of the through-tie of FIG. 12.

Turning now to FIGS. 12, 13, and 14, an adjustable variation of the through-tie 24 is shown. In this variation a single through-tie 24 has the capacity to be engaged by the latches 26 at a variety of the distance along its axial length, whereby a single through-tie 24 design may be used for engaging latches 26 on barriers 4,6 spaced apart a variety of distances.

The adjustable through-ties 24 would typically be 4 inches to 30 inches long, preferably 8 inches to 24 inches long, and most preferably 12 inches to 20 inches long, but all would ideally have the same features. Adjacent a first axial end 76, preferably about ½ inch from the terminus, one or more primary notches 78 are provided, leaving a cross section of 7/32 inch by 7/32 inch and ½ inch in length. At the opposing second axial end 80, starting preferably about 8 inches from the first axial end 76, one to several secondary notches 82 are provided, which also have a cross section of 7/32 inch by 7/32 inch and ½ inch in length.

A first set of secondary notches 82 is present on first opposing faces 84 of the through-tie 24. The remaining second opposing faces 86 of the through-tie 24, perpendicular to the first opposing faces 84, also posses secondary notches 82, but these secondary notches 82 are be staggered ¼" from the set of secondary notches 82 on the first opposing faces 84, such that the tie could be adjusted by turning it 90 degrees.

The terminus of the second axial end 80 of the through-tie 24 could be shaped as flattened round or rectangular handle 88, similar to a "violin key" shape, so as to facilitate rotation. The interval of regular notches 32 may be ¼ inch notches 32 spaced ¼ inches apart.

At the first axial end 76, the through-tie 24 stock material may be machined such that the primary notches 78 on the first opposing faces 84 causes a cross section of the remaining area to measure 7/32 inches wide and ½ inches long (along the axial length of the through-tie 24). On the second opposing faces 86, similar, but offset, primary notches 78 are formed such that the remaining cross section is 7/32 inches wide and ½ inches long (along the axial length of the through-tie 24). The offset primary notch 78 is offset ⅛ inches from the primary notch 78 on the first opposing faces 84.

Though the through-tie 24 shown in the referenced figures are shown constructed of ⅜ inch square stock, the invention also contemplates including through-ties 24 of round stock, and stocks of varying widths including ¼ inch and less, and ½ inch and more.

It is anticipated that the notches 32 are made by machining faces with the desired notch profile. The notching on two faces allows for a ⅛ inch adjustment since the panel will be sloped.

On the second axial end 80 of the through-ties 24, the flattened round handle 88 is used to twist the tie into the desired notches 32 for the required dimension which changes from the top to the bottom on the slanted forms. Then, there are a series of notches 32 similar to as previously described for the first axial end 76 except that the offset on this end is ¼ inch. Therefore it is possible to obtain any required dimension within ⅛ inch by utilizing one of two notches 32 on the first axial and any corresponding notch 32 on the second axial end 80 that fits into the formwork clamp which is shown below.

The tables that follow provide one example of various embodiments for the footless forms 2 using vertical elongate panels 16 with through-ties 24 and latches 26, and horizontal elongate panels 38 with clip-ties 40, for 8 foot tall walls, 10 foot tall walls, and 4 foot tall walls, with just one potential example of tie placement for each variation. The tables also provide dimensions for base widths of 16 inches, 20 inches and 24 inches for various embodiments.

TABLE T-1

8' FootLess Forms-16 inch base

| | Vertical Elongate Panels Tie Elevation from Ground (inches) | Width between forms at Tie Elevation Shown (inches) |
|---|---|---|
| Bottom Form | 0 | 16.75 |
| Bottom Tie | 8 | 16.00 |
| | 24 | 14.00 |
| | 40 | 12.00 |
| | 56 | 10.00 |
| | 72 | 8.00 |
| Top Tie | 88 | 6.00 |
| Top Form | 96 | 5.25 |

Primary Angle of Inclination α: 82.875°

TABLE T-2

| 8' FootLess Forms-16 inch base | | |
|---|---|---|
| | Horizontal Elongate Panels Tie Elevation from Ground (inches) | Width between forms at Tie Elevation Shown (inches) |
| Bottom | 0 | 16.00 |
| First/Second | 24 | 13.50 |
| Second/Third | 48 | 11.00 |
| Third/Fourth | 72 | 8.50 |
| Top | 96 | 6.00 |

Primary Angle of Inclination α: 84.053°

TABLE T-3

| 8' FootLess Forms-20 inch base | | |
|---|---|---|
| | Vertical Elongate Panels Tie Elevation from Ground (inches) | Width between forms at Tie Elevation Shown (inches) |
| Bottom Form | 0 | 21.05 |
| Bottom Tie | 8 | 20.00 |
| | 24 | 17.20 |
| | 40 | 14.40 |
| | 56 | 11.60 |
| | 72 | 8.80 |
| Top Tie | 88 | 6.00 |
| Top Form | 96 | 4.95 |

Primary Angle of Inclination α: 80.074°

TABLE T-4

| 8' FootLess Forms-20 inch base | | |
|---|---|---|
| | Horizontal Elongate Panels Tie Elevation from Ground (inches) | Width between forms at Tie Elevation Shown (inches) |
| Bottom | 0 | 20.00 |
| First/Second | 24 | 16.50 |
| Second/Third | 48 | 13.00 |
| Third/Fourth | 72 | 9.50 |
| Top | 96 | 6.00 |

Primary Angle of Inclination α: 81.703°

TABLE T-5

| 8' FootLess Forms-24 inch base | | |
|---|---|---|
| | Vertical Elongate Panels Tie Elevation from Ground (inches) | Width between forms at Tie Elevation Shown (inches) |
| Bottom Form | 0 | 25.35 |
| Bottom Tie | 8 | 24.00 |
| | 24 | 20.40 |
| | 40 | 16.80 |
| | 56 | 13.20 |
| | 72 | 9.60 |
| Top Tie | 88 | 6.00 |
| Top Form | 96 | 4.65 |

Primary Angle of Inclination α: 77.320°

TABLE T-6

| 8' FootLess Forms-24 inch base | | |
|---|---|---|
| | Horizontal Elongate Panels Tie Elevation from Ground (inches) | Width between forms at Tie Elevation Shown (inches) |
| Bottom | 0 | 24.00 |
| First/Second | 24 | 19.50 |
| Second/Third | 48 | 15.00 |
| Third/Fourth | 72 | 10.50 |
| Top | 96 | 6.00 |

Primary Angle of Inclination α: 79.380°

TABLE T-7

| 10' FootLess Forms-16 inch base | | |
|---|---|---|
| | Vertical Elongate Panels Tie Elevation from Ground (inches) | Width between forms at Tie Elevation Shown (inches) |
| Bottom Form | 0 | 16.83 |
| Bottom Tie | 8 | 16.00 |
| | 24 | 14.33 |
| | 40 | 12.67 |
| | 56 | 11.00 |
| | 72 | 9.33 |
| | 88 | 7.67 |
| Top Tie | 104 | 6.00 |
| Top Form | 120 | 4.33 |

Primary Angle of Inclination α: 84.053°

TABLE T-8

| 10' FootLess Forms-16 inch base | | |
|---|---|---|
| | Horizontal Elongate Panels Tie Elevation from Ground (inches) | Width between forms at Tie Elevation Shown (inches) |
| Bottom | 0 | 16.00 |
| First/Second | 24 | 14.00 |
| Second/Third | 48 | 12.00 |
| Third/Fourth | 72 | 10.00 |
| Fourth/Fifth | 96 | 8.00 |
| Top | 120 | 6.00 |

Primary Angle of Inclination α: 85.236°

TABLE T-9

| 10' FootLess Forms-20 inch base | | |
|---|---|---|
| | Vertical Elongate Panels Tie Elevation from Ground (inches) | Width between forms at Tie Elevation Shown (inches) |
| Bottom Form | 0 | 21.17 |
| Bottom Tie | 8 | 20.00 |
| | 24 | 17.67 |
| | 40 | 15.33 |
| | 56 | 13.00 |
| | 72 | 10.67 |
| | 88 | 8.33 |
| Top Tie | 104 | 6.00 |
| Top Form | 120 | 3.67 |

Primary Angle of Inclination α: 81.703°

TABLE T-10

| 10' FootLess Forms-20 inch base | | |
|---|---|---|
| | Horizontal Elongate Panels Tie Elevation from Ground (inches) | Width between forms at Tie Elevation Shown (inches) |
| Bottom | 0 | 20.00 |
| First/Second | 24 | 17.20 |
| Second/Third | 48 | 14.40 |
| Third/Fourth | 72 | 11.60 |
| Fourth/Fifth | 96 | 8.80 |
| Top | 120 | 6.00 |

Primary Angle of Inclination α: 83.346°

TABLE T-11

| 10' FootLess Forms-24 inch base | | |
|---|---|---|
| | Vertical Elongate Panels Tie Elevation from Ground (inches) | Width between forms at Tie Elevation Shown (inches) |
| Bottom Form | 0 | 25.50 |
| Bottom Tie | 8 | 24.00 |
| | 24 | 21.00 |
| | 40 | 18.00 |
| | 56 | 15.00 |
| | 72 | 12.00 |
| | 88 | 9.00 |
| Top Tie | 104 | 6.00 |
| Top Form | 120 | 3.00 |

Primary Angle of Inclination α: 79.380°

TABLE T-12

| 10' FootLess Forms-24 inch base | | |
|---|---|---|
| | Horizontal Elongate Panels Tie Elevation from Ground (inches) | Width between forms at Tie Elevation Shown (inches) |
| Bottom | 0 | 24.00 |
| First/Second | 24 | 20.40 |
| Second/Third | 48 | 16.80 |
| Third/Fourth | 72 | 13.20 |
| Fourth/Fifth | 96 | 9.60 |
| Top | 120 | 6.00 |

Primary Angle of Inclination α: 81.469°

TABLE T-13

| 4' FootLess Forms-16 inch base | | |
|---|---|---|
| | Vertical Elongate Panels Tie Elevation from Ground (inches) | Width between forms at Tie Elevation Shown (inches) |
| Bottom Form | 0 | 18.50 |
| Bottom Tie | 8 | 16.00 |
| | 24 | 11.00 |
| Top Tie | 40 | 6.00 |
| Top Form | 48 | 3.50 |

Primary Angle of Inclination α: 72.646°

TABLE T-14

| 4' FootLess Forms-16 inch base | | |
|---|---|---|
| | Horizontal Elongate Panels Tie Elevation from Ground (inches) | Width between forms at Tie Elevation Shown (inches) |
| Bottom | 0 | 16.00 |
| First/Second | 24 | 11.00 |
| Top | 48 | 6.00 |

Primary Angle of Inclination α: 78.232°

TABLE T-15

| 4' FootLess Forms-20 inch base | | |
|---|---|---|
| | Vertical Elongate Panels Tie Elevation from Ground (inches) | Width between forms at Tie Elevation Shown (inches) |
| Bottom Form | 0 | 23.50 |
| Bottom Tie | 8 | 20.00 |
| | 24 | 13.00 |
| Top Tie | 40 | 6.00 |
| Top Form | 48 | 2.50 |

Primary Angle of Inclination α: 66.371°

TABLE T-16

| 4' FootLess Forms-20 inch base | | |
|---|---|---|
| | Horizontal Elongate Panels Tie Elevation from Ground (inches) | Width between forms at Tie Elevation Shown (inches) |
| Bottom | 0 | 20.00 |
| First/Second | 24 | 13.00 |
| Top | 48 | 6.00 |

Primary Angle of Inclination α: 73.740°

TABLE T-17

| 4' FootLess Forms-24 inch base | | |
|---|---|---|
| | Vertical Elongate Panels Tie Elevation from Ground (inches) | Width between forms at Tie Elevation Shown (inches) |
| Bottom Form | 0 | 25.35 |
| Bottom Tie | 8 | 24.00 |
| | 24 | 20.40 |
| Top Tie | 40 | 6.00 |
| Top Form | 48 | 4.65 |

Primary Angle of Inclination α: 77.320°

TABLE T-18

| 4' FootLess Forms-24 inch base | | |
|---|---|---|
| | Horizontal Elongate Panels Tie Elevation from Ground (inches) | Width between forms at Tie Elevation Shown (inches) |
| Bottom | 0 | 24.00 |
| First/Second | 24 | 19.50 |
| Top | 48 | 6.00 |

Primary Angle of Inclination α: 75.964°

TABLE T-19

| 8' FootLess Forms-16 inch base, 8 inch wall Non-planar Inclined Barrier | | |
|---|---|---|
| | Vertical Elongate Panels Tie Elevation from Ground (inches) | Width between forms at Tie Elevation Shown (inches) |
| Bottom Form | 0 | 16.00 |
| Bottom Tie | 8 | 13.33 |
| | 24 | 8.00 |
| | 40 | 8.00 |
| | 56 | 8.00 |
| | 72 | 6.00 |
| Top Tie | 88 | 8.00 |
| Top Form | 96 | 8.00 |

Primary Angle of Inclination α: 71.565°

TABLE T-20

| 8' FootLess Forms-16 inch base, 8 inch wall Non-planar Inclined Barrier | | |
|---|---|---|
| | Horizontal Elongate Panels Tie Elevation from Ground (inches) | Width between forms at Tie Elevation Shown (inches) |
| Bottom | 0 | 16.00 |
| First/Second | 24 | 8.00 |
| Second/Third | 48 | 8.00 |
| Third/Fourth | 72 | 8.00 |
| Top | 96 | 8.00 |

Primary Angle of Inclination α: 71.565°

TABLE T-21

| 8' FootLess Forms-20 inch base, 8 inch wall Non-planar Inclined Barrier | | |
|---|---|---|
| | Vertical Elongate Panels Tie Elevation from Ground (inches) | Width between forms at Tie Elevation Shown (inches) |
| Bottom Form | 0 | 20.00 |
| Bottom Tie | 8 | 16.00 |
| | 24 | 8.00 |
| | 40 | 8.00 |
| | 56 | 8.00 |
| | 72 | 8.00 |
| Top Tie | 88 | 8.00 |
| Top Form | 96 | 8.00 |

Primary Angle of Inclination α: 63.435°

TABLE T-22

| 8' FootLess Forms-20 inch base, 8 inch wall Non-planar Inclined Barrier | | |
|---|---|---|
| | Horizontal Elongate Panels Tie Elevation from Ground (inches) | Width between forms at Tie Elevation Shown (inches) |
| Bottom | 0 | 20.00 |
| First/Second | 24 | 8.00 |
| Second/Third | 48 | 8.00 |
| Third/Fourth | 72 | 8.00 |
| Top | 96 | 8.00 |

Primary Angle of Inclination α: 63.435°

TABLE T-23

| 8' FootLess Forms-24 inch base, 8 inch wall Non-planar Inclined Barrier | | |
|---|---|---|
| | Vertical Elongate Panels Tie Elevation from Ground (inches) | Width between forms at Tie Elevation Shown (inches) |
| Bottom Form | 0 | 24 |
| Bottom Tie | 8 | 18.67 |
| | 24 | 8.00 |
| | 40 | 8.00 |
| | 56 | 8.00 |
| | 72 | 8.00 |
| Top Tie | 88 | 8.00 |
| Top Form | 96 | 8.00 |

Primary Angle of Inclination α: 56.310°

TABLE T-24

| 8' FootLess Forms-24 inch base, 8 inch wall Non-planar Inclined Barrier | | |
|---|---|---|
| | Horizontal Elongate Panels Tie Elevation from Ground (inches) | Width between forms at Tie Elevation Shown (inches) |
| Bottom | 0 | 24.00 |
| First/Second | 24 | 8.00 |
| Second/Third | 48 | 8.00 |
| Third/Fourth | 72 | 8.00 |
| Top | 96 | 8.00 |

Primary Angle of Inclination α: 56.310°

TABLE T-25

| 8' FootLess Forms-16 inch base, 8 inch wall Two Non-planar Barriers | | |
|---|---|---|
| | Vertical Elongate Panels Tie Elevation from Ground (inches) | Width between forms at Tie Elevation Shown (inches) |
| Bottom Form | 0 | 16.00 |
| Bottom Tie | 8 | 13.33 |
| | 24 | 8.00 |
| | 40 | 8.00 |
| | 56 | 8.00 |
| | 72 | 6.00 |
| Top Tie | 88 | 8.00 |
| Top Form | 96 | 8.00 |

Primary Angle of Inclination α: 80.538°

TABLE T-26

| 8' FootLess Forms-16 inch base, 8 inch wall Two Non-planar Barriers | | |
|---|---|---|
| | Horizontal Elongate Panels Tie Elevation from Ground (inches) | Width between forms at Tie Elevation Shown (inches) |
| Bottom | 0 | 16.00 |
| First/Second | 24 | 8.00 |
| Second/Third | 48 | 8.00 |
| Third/Fourth | 72 | 8.00 |
| Top | 96 | 8.00 |

Primary Angle of Inclination α: 80.538°

TABLE T-27

| 8' FootLess Forms-20 inch base, 8 inch wall Two Non-planar Barriers | | |
|---|---|---|
| | Vertical Elongate Panels Tie Elevation from Ground (inches) | Width between forms at Tie Elevation Shown (inches) |
| Bottom Form | 0 | 20.00 |
| Bottom Tie | 8 | 16.00 |
| | 24 | 8.00 |
| | 40 | 8.00 |
| | 56 | 8.00 |
| | 72 | 8.00 |
| Top Tie | 88 | 8.00 |
| Top Form | 96 | 8.00 |

Primary Angle of Inclination α: 75.964°

TABLE T-28

| 8' FootLess Forms-20 inch base, 8 inch wall Two Non-planar Barriers | | |
|---|---|---|
| | Horizontal Elongate Panels Tie Elevation from Ground (inches) | Width between forms at Tie Elevation Shown (inches) |
| Bottom | 0 | 20.00 |
| First/Second | 24 | 8.00 |
| Second/Third | 48 | 8.00 |
| Third/Fourth | 72 | 8.00 |
| Top | 96 | 8.00 |

Primary Angle of Inclination α: 75.964°

TABLE T-29

| 8' FootLess Forms-24 inch base, 8 inch wall Two Non-planar Barriers | | |
|---|---|---|
| | Vertical Elongate Panels Tie Elevation from Ground (inches) | Width between forms at Tie Elevation Shown (inches) |
| Bottom Form | 0 | 24 |
| Bottom Tie | 8 | 18.67 |
| | 24 | 8.00 |
| | 40 | 8.00 |
| | 56 | 8.00 |
| | 72 | 8.00 |
| Top Tie | 88 | 8.00 |
| Top Form | 96 | 8.00 |

Primary Angle of Inclination α: 71.565°

TABLE T-30

| 8' FootLess Forms-24 inch base, 8 inch wall Two Non-planar Barriers | | |
|---|---|---|
| | Horizontal Elongate Panels Tie Elevation from Ground (inches) | Width between forms at Tie Elevation Shown (inches) |
| Bottom | 0 | 24.00 |
| First/Second | 24 | 8.00 |
| Second/Third | 48 | 8.00 |
| Third/Fourth | 72 | 8.00 |
| Top | 96 | 8.00 |

Primary Angle of Inclination α: 71.565°

TABLE T-31

| 8' FootLess Forms-16 inch base Double Sloped Wall | | |
|---|---|---|
| | Vertical Elongate Panels Tie Elevation from Ground (inches) | Width between forms at Tie Elevation Shown (inches) |
| Bottom Form | 0 | 16.75 |
| Bottom Tie | 8 | 16.00 |
| | 24 | 14.00 |
| | 40 | 12.00 |
| | 56 | 10.00 |
| | 72 | 8.00 |
| Top Tie | 88 | 6.00 |
| Top Form | 96 | 5.25 |

Primary Angle of Inclination α: 86.424°

TABLE T-32

| 8' FootLess Forms-16 inch base Double Sloped Wall | | |
|---|---|---|
| | Horizontal Elongate Panels Tie Elevation from Ground (inches) | Width between forms at Tie Elevation Shown (inches) |
| Bottom | 0 | 16.00 |
| First/Second | 24 | 13.50 |
| Second/Third | 48 | 11.00 |
| Third/Fourth | 72 | 8.50 |
| Top | 96 | 6.00 |

Primary Angle of Inclination α: 87.019°

TABLE T-33

| 8' FootLess Forms-20 inch base Double Sloped Wall | | |
|---|---|---|
| | Vertical Elongate Panels Tie Elevation from Ground (inches) | Width between forms at Tie Elevation Shown (inches) |
| Bottom Form | 0 | 21.05 |
| Bottom Tie | 8 | 20.00 |
| | 24 | 17.20 |
| | 40 | 14.40 |
| | 56 | 11.60 |
| | 72 | 8.80 |
| Top Tie | 88 | 6.00 |
| Top Form | 96 | 4.95 |

Primary Angle of Inclination α: 84.999°

TABLE T-34

| 8' FootLess Forms-20 inch base Double Sloped Wall | | |
|---|---|---|
| | Horizontal Elongate Panels Tie Elevation from Ground (inches) | Width between forms at Tie Elevation Shown (inches) |
| Bottom | 0 | 20.00 |
| First/Second | 24 | 16.50 |
| Second/Third | 48 | 13.00 |
| Third/Fourth | 72 | 9.50 |
| Top | 96 | 6.00 |

Primary Angle of Inclination α: 85.830°

TABLE T-35

| 8' FootLess Forms-24 inch base Double Sloped Wall | | |
|---|---|---|
| | Vertical Elongate Panels Tie Elevation from Ground (inches) | Width between forms at Tie Elevation Shown (inches) |
| Bottom Form | 0 | 25.35 |
| Bottom Tie | 8 | 24.00 |
| | 24 | 20.40 |
| | 40 | 16.80 |
| | 56 | 13.20 |
| | 72 | 9.60 |
| Top Tie | 88 | 6.00 |
| Top Form | 96 | 4.65 |

Primary Angle of Inclination α: 83.581°

TABLE T-36

| 8' FootLess Forms-24 inch base Double Sloped Wall | | |
|---|---|---|
| | Horizontal Elongate Panels Tie Elevation from Ground (inches) | Width between forms at Tie Elevation Shown (inches) |
| Bottom | 0 | 24.00 |
| First/Second | 24 | 19.50 |
| Second/Third | 48 | 15.00 |
| Third/Fourth | 72 | 10.50 |
| Top | 96 | 6.00 |

Primary Angle of Inclination α: 84.644°

In the above description and appended drawings, it is to be appreciated that only the terms "consisting of" and "consisting only of" are to be construed in the limitative sense while of all other terms are to be construed as being open-ended and given the broadest possible meaning.

Since certain changes may be made in the above described improved, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore I claim:

1. A method of constructing a footing-free building foundation comprising the steps of:

erecting a first barrier;

erecting an opposed second barrier oriented at a non-parallel angle toward the first barrier; and securing the first barrier to the second barrier with a plurality of ties at a plurality of different axial lengths such that the first barrier, the second barrier and the level ground define a void accessible through a space between an upper edge of the first barrier and an upper edge of the second barrier;

filling the void with non-set concrete;

allowing the concrete to cure;

removing the first barrier and the second barrier from the cured concrete.

2. The method of claim 1, further comprising the step of arranging the first barrier orthogonally to a level ground beneath both the first barrier and the second barrier.

3. The method of claim 1, further comprising the step of arranging a base edge of each of the first and the second barrier are adjacent to the level ground.

4. The method of claim 1, further comprising the step of providing that a cross section of the void being shaped as a right trapezoid.

5. The method of claim 1, further comprising the step of providing that the level ground is non-cementitious, and, providing that once assembled, the form is free standing both before and after concrete has been poured into the form.

6. The method of claim 1, further comprising the step of providing that the plurality of ties are of at least three different axial length.

7. The method of claim 1, further comprising the step of providing that the plurality of ties have more than two engagement locations for releasably engaging with the first barrier and the second barrier.

8. The method of claim 1, further comprising the step of providing a plurality of latches, with at least one on each of the first barrier and the second barrier, that engage with each of the ties to prevent axial movement of the ties with relation to the first barrier and the second barrier.

9. The method of claim 1, further comprising the step of providing the ties have a plurality of clip heads, with a first clip head engaging with an edge of the first barrier and a second clip edge engaging with a edge of the second barrier.

10. The method of claim 9, further comprising the steps of engaging a base edge of each of the first barrier and the second barrier with base clip-ties, engaging an upper edge of each of the first barrier and the second barrier with upper clip-ties, and engaging intermediate edges of each of the first barrier and the second barrier with intermediate clip-ties.

11. The method of claim 10, further comprising the step of arranging the base clip-ties adjacent to a level ground beneath both the first barrier and the second barrier, arranging the upper clip-ties are farther spaced from the level ground, and arranging the intermediate clip-ties vertically between the upper clip-ties and the base clip-ties.

12. The method of claim 11, further comprising the step of providing the clip-ties further comprise a shank that supports the plurality of clip heads, providing at least one intermediate clip-tie has at a first axial location along the shank an upper coupling element on an upper side of the shank inclined at a first angle of inclination to the shank and at the same axial location an opposed lower coupling element on a lower side of the shank inclined at a second angle of inclination to the shank, and providing the second angle of inclination to the shank is neither congruent nor supplementary to the first angle of inclination to the shank.

13. The method of claim 1, further comprising the step of both providing the first barrier and the second barrier are planar, providing the first barrier has a uniform angle of inclination with respect to a level ground beneath both the first barrier and the second barrier, and providing the second barrier has a second uniform angle of inclination with respect to the level ground.

14. The method of claim 1, further comprising the step of providing both the first barrier and the second barrier are planar, and arranging the first barrier and the second barrier such that each has a congruent uniform angle of inclination with respect to a level ground beneath both the first barrier and the second barrier.

15. The method of claim 1, further comprising the step of providing at least one of the first barrier and the second barrier are not fully planar, and providing the other of the first barrier and the second barrier has a uniform angle of inclination with respect to a level ground beneath both the first barrier and the second barrier.

16. The method of claim 1, further comprising the step of providing at least one of the first barrier and the second barrier are comprised of a plurality of horizontal elongate panels.

17. The method of claim 1, further comprising the step of comprising at least one of the first barrier and the second barrier of a plurality of vertical elongate panels.

18. The method of claim 1, further comprising the step of comprising at least one of the first barrier and the second barrier of a plurality of elongate panels measuring between 90 inches and 130 inches along a first edge, and measuring between 16 inches and 36 inches along a second edge.

19. A method of constructing a footing-free building foundation comprising the steps of:

placing a plurality of elongate panels adjacent to and orthogonal to a level ground to define an orthogonal barrier;

placing a plurality of elongate panels adjacent to and at a non-right angle of inclination to the level ground to define an inclined barrier;

securing the orthogonal barrier to the inclined barrier with a plurality of ties at a plurality of different axial lengths such that the orthogonal barrier, the inclined barrier and the level ground define a void accessible through a space between an upper edge of the orthogonal barrier and an upper edge of the inclined barrier;

substantially filling the void in a single application with non-set concrete;

allowing the concrete to cure;

removing the orthogonal barrier and the inclined barrier from the cured concrete.

20. A foot free foundation form comprising a removable first barrier comprised of a first plurality of adjacent elongate panels;

an opposed removable second barrier comprised of a second plurality of adjacent elongate panels oriented at a non-parallel angle toward the first barrier;

a plurality of elongate ties each engage with the first barrier and the second barrier, the plurality of ties being a plurality of different axial lengths;

a plurality of elongate braces attached to at least one face of at least one of the first barrier and the second barrier;

the first barrier being arranged orthogonal to a level ground beneath both the first barrier and the second barrier;

the second barrier being arranged at a an angle of inclination to the level ground between 75 degrees and 86 degrees;

a base edge of each of the first and the second barrier being adjacent to the level ground, with the base edges of each of the first and the second barrier being laterally spaced between 16 inches and 24 inches from one another;

the first barrier, the second barrier, and the level ground defining an interior void;

a cross section of the interior void being shaped as a right trapezoid;

the level ground being non-cementitious;

the plurality of ties being of at least three different axial lengths;

the plurality of ties including one of a plurality of engagement notches or a plurality of clip heads to engage with both the first barrier and the second barrier;

the elongate panels measuring between 90 inches and 130 inches along a first edge, and measuring between 16 inches and 36 inches along a second edge;

both the first barrier and the second barrier being planar, with the first barrier having a uniform angle of inclination with respect to the level ground, and the second barrier having a second uniform angle of inclination with respect to the level ground; and at least the first and the second barrier being removable after a concrete filling has cured.

* * * * *